United States Patent [19]

Mathis et al.

[11] Patent Number: 4,500,706

[45] Date of Patent: Feb. 19, 1985

[54] METHOD OF PRODUCING EXTRUSION GRADE POLY(ARYLENE SULFIDE)

[75] Inventors: Ronald D. Mathis; Jerry O. Reed, both of Bartlesville, Okla.; Gerald E. Hagler, Simpsonville, S.C.

[73] Assignee: Phillips Petroleum Company, Bartlesville, Okla.

[21] Appl. No.: 406,155

[22] Filed: Aug. 9, 1982

[51] Int. Cl.[3] ..... C08J 5/00; C08G 75/02

[52] U.S. Cl. ..... 528/502; 210/767; 264/176 F; 528/481

[58] Field of Search ..... 528/481, 502, 503

[56] References Cited

U.S. PATENT DOCUMENTS

| | | | |
|---|---|---|---|
| 2,883,261 | 4/1959 | McGeorge, Jr. | 264/176 F |
| 3,071,808 | 1/1963 | MacKinnon | 18/8 |
| 3,480,706 | 11/1969 | Carpenter et al. | 264/176 |
| 3,639,557 | 2/1972 | Pfannenschimd | 264/176 F |
| 3,938,924 | 2/1976 | Abella et al. | 425/147 |
| 4,077,880 | 3/1978 | Lorenz et al. | 210/65 |

OTHER PUBLICATIONS

*Flow Systems: Filter Media,* Fluid Dynamics, Brunswick Corporation, 1978.

*Primary Examiner*—Christopher A. Henderson

[57] ABSTRACT

A method of producing poly(arylene sulfide) resin suitable for the commercial production of fibers. The method includes the two stage melt filtration of a suitable poly(arylene sulfide) polymer, e.g., poly(p-phenylene sulfide), through a primary filter having an absolute micron rating of no more than about 125 microns, and through a secondary filter having a maximum absolute micron rating of about 80 or a substantially equivalent filter capacity. Also disclosed are various forms of apparatus for performing the method. In one form the apparatus employs a depth type filter of metallurgically bonded micronic size stainless steel fibers as the primary filter and one or more edge sealed screen combinations each containing one 325 mesh screen as the secondary filter. A secondary filter comprising a mesh screen and a quantity of suitable sand is also disclosed.

62 Claims, 4 Drawing Figures

METHOD OF PRODUCING EXTRUSION GRADE POLY(ARYLENE SULFIDE)

The present invention relates generally to the production of poly(arylene)sulfide) polymeric products. In one aspect the invention relates to a method of filtering molten poly(arylene sulfide) polymer in the production of a poly(arylene sulfide) polymer product.

In the production of extruded polymer products, such as the melt spinning of normally solid thermoplastic polymeric resins into continuous filaments, it is often necessary to filter the molten polymeric material prior to the step of extruding the filaments. Such filtration is required to remove the material, e.g., gels and particulate matter, from the molten polymeric resin, the presence of such materials being the potential cause of spinneret fouling and of filament breakage during spinning as well as during subsequent handling of the filaments, e.g., during drawing of the filaments.

In the filtration of molten polymeric resins prior to their extrusion as, for example, filaments, various filtration schemes have been used in the past, including single stage and multiple stage filtration lines. Various types of filter media, including mesh screens, sintered metal fibers and sand have been employed in such filtration of molten polymers prior to extrusion or melt spinning of the polymers into polymer products.

A problem associated with such filtration is the plugging of the filter media by the filtrate separated from the polymeric resins. The incidence of filter plugging is dependent, for example, on the type of polymeric resin, the type of polymerization process used to produce the polymeric resin, and the degree of contamination of the polymeric resin. As a filter becomes progressively plugged, the pressure drop across the filter increases.

In order for a filtration system to provide commercial quantities of filtered molten polymeric resin for extrusion purposes, the system must first of all provide filtered molten polymer with the desired degree of purity for the particular extrusion process, and second of all provide a desired maximum amount of process running time before filter plugging causes the pressure drop thereacross to reach a maximum allowable value thus necessitating taking the plugged filter out of service for cleaning or replacement.

Due to the nature of poly(arylene sulfide) polymer, e.g., poly(phenylene sulfide) polymer, a filtration system adequate to provide commercial quantities of such polymers suitable for melt spinning of filaments or fibers has not heretofore been available.

Accordingly, in order to overcome the problems noted above, we have discovered a method of preparing a polymer product which permits the production of extrusion grade poly(arylene sulfide), resin, e.g., poly(-phenylene sulfide) resin, in commercial quantities and we have further invented novel apparatus for the practice of such method. The method of our invention comprises forcing molten polymer through primary filter means having a maximum absolute micron rating of no more than about 125 to provide molten primary filtered polymer or resin, and forcing the molten primary filtered polymer or resin through secondary filter means having a maximum absolute micron rating of no more than about 80 or an equivalent filtration capability to provide molten secondary filtered polymer or resin. The novel apparatus of the invention comprises first means for receiving a quantity of molten polymer from a molten polymer source, said first means comprising primary filter means having a maximum absolute micron rating of no more than about 125 for filtering the thus received molten polymer to provide molten primary filtered polymer; and second means for receiving said molten primary filtered polymer from said first means, said second means comprising secondary filter means having a maximum absolute micron rating of no more than about 80 or an equivalent filtration capability for filtering the thus received molten primary filtered polymer to provide molten secondary filtered polymer.

An object of this invention is to provide a new filtration method suitable for use with molten poly(arylene sulfide) polymer material.

Still another object of the invention is to provide method for the production of a poly(arylene sulfide) polymer product which is economical in operation.

Yet another object of the invention is to provide method suitable for the economical production of poly(arylene sulfide) material suitable for melt spinning into one or more filaments.

Still another object of this invention is to provide method for the production of extrusion grade poly(arylene sulfide) material which overcomes the deficiencies of the prior art.

Another object of this invention is to provide method for the economical production of an extruded poly(phenylene sulfide) product.

Other objects, aspects and advantages of this invention will be evident from the following detailed description when read in conjunction with the accompanying drawings in which.

The term "poly(arylene sulfide) polymer" as used in this specification is intended to include polymers of the type which are prepared as described in U.S. Pat. No. 3,354,129, issued to Edmonds et al, and U.S. Pat. No. 3,919,177, issued to Campbell. As disclosed in U.S. Pat. No. 3,354,129, these polymers can be prepared by reacting a polyhalo-substituted cyclic compound containing unsaturation between adjacent ring atoms and an alkali metal sulfide in a polar organic compound. The resulting polymer contains the cyclic structure of the polyhalo-substituted compound coupled in repeating units through a sulfur atom. The polymers which are preferred for use in this invention, because of their frequent occurrence in polymer production and processing, are those polymers having the repeating unit —R—S— where R is phenylene, biphenylene, naphthylene, biphenylene ether, or a lower alkyl-substituted derivative thereof. By "lower alkyl" is meant alkyl groups having one to six carbon atoms such as methyl, propyl, isobutyl, n-hexyl, etc. Polymer can also be made according to a process utilizing a p-dihalobenzene, an alkali metal sulfide, an organic amide, and an alkali metal carboxylate as in U.S. Pat. No. 3,919,177.

As used herein, all numerical wire mesh designations refer to U.S. Standard Sieve Series, ASTM Specification E-11-61 (which is identical to Canadian Standard Sieve Series, 8-GP-16), unless otherwise noted.

Figure 1:
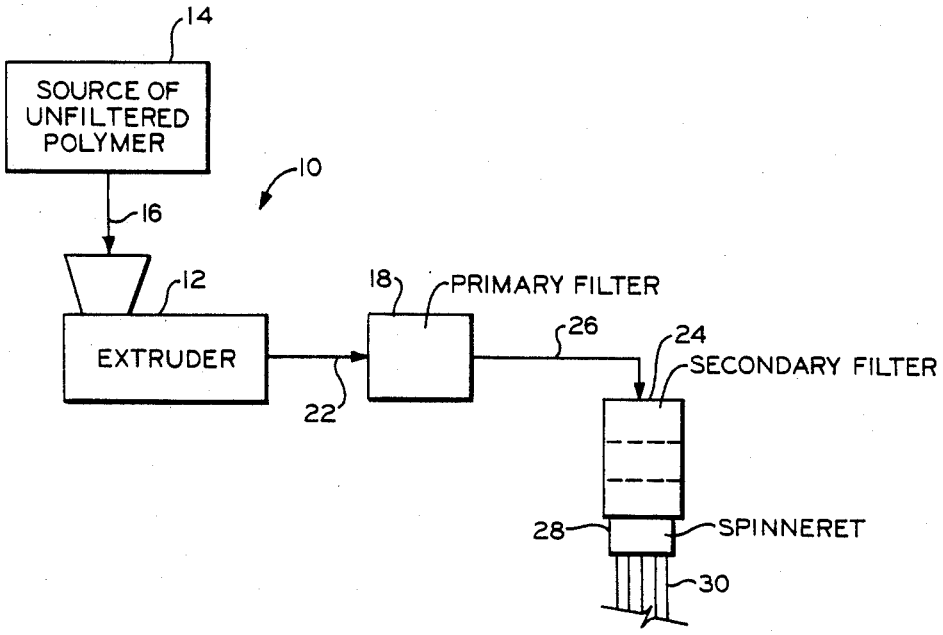
FIG. 1 is a schematic diagram of apparatus constructed in accordance with the present invention.

Referring now to the drawings, FIG. 1 illustrates a system 10 constructed in accordance with the present invention. The system 10 comprises an extruder 12 which is provided with means for receiving normally solid unfiltered thermoplastic polymer, for example in powder or pellet form, from a suitable source 14 via conduit 16 or by other suitable conveyance means. The extruder 12, which may be a single screw or twin screw extruder of suitable capacity, melts the unfiltered polymer and extrudes the thus produced polymer melt to a primary filter 18 via a suitable conduit 22. The extruded polymer or resin melt is forced through the primary filter 18 to a secondary filter 24 via a suitable conduit 26 thus producing a primary filtered polymer or resin melt. The primary filtered polymer melt is forced through the secondary filter 24, thus producing a secondary filtered polymer or resin melt which is, in turn, forced through one or more apertures in a suitable spinneret 28 to produce one or more molten polymer filaments or fibers 30 which are subsequently cooled by suitable means (not shown), for example, fluid cooling such as air or water cooling, to provide polymer filaments or fibers.

Figure 2:
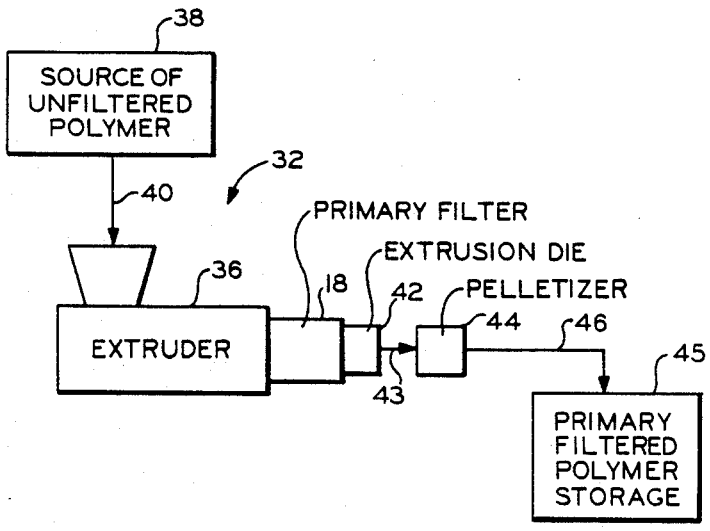
FIG. 2 is a schematic diagram of the first portion of an alternate form of apparatus constructed in accordance with the present invention.
Figure 3:
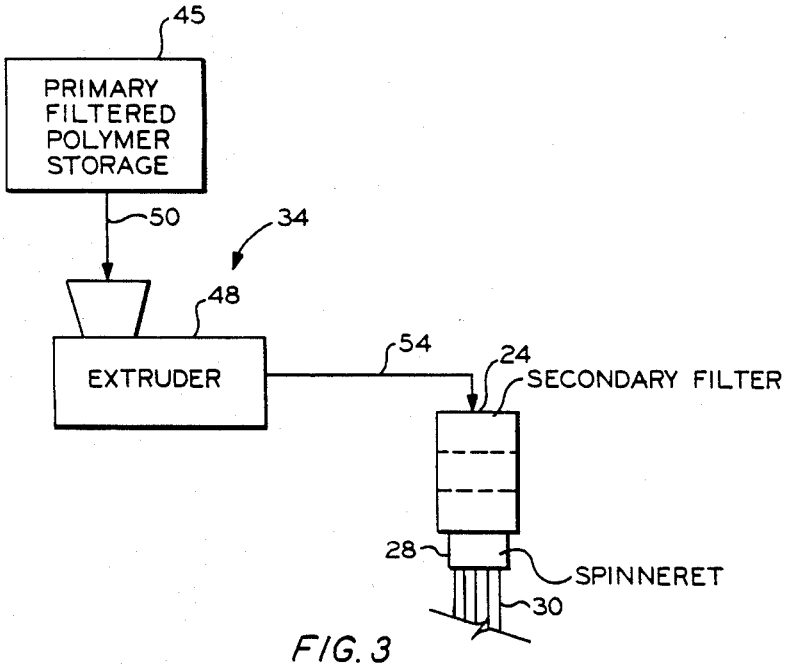
FIG. 3 is a schematic diagram of the second portion of the apparatus of FIG. 2.

Referring further to FIGS. 2 and 3, an alternate system constructed in accordance with the present invention is illustrated wherein identical elements are identified by the same reference characters. This alternate system comprises a first subsystem 32 illustrated in FIG. 2 and a second subsystem 34 illustrated in FIG. 3. The subsystem 32 comprises an extruder 36 which receives normally solid unfiltered thermoplastic polymer, for example in powder or pellet form, from a suitable source 38 via conduit 40 or other suitable conveyance means. The extruder 36, which may also be a single screw or a twin screw extruder of suitable capacity, melts the unfiltered polymer and forces the thus produced polymer melt through the primary filter 18 and then through an extrusion die 42, e.g., a strand die, a strand cooling zone 43 and a strand cutting device or pelletizer 44 to a suitable storage container 45 for the thus produced primary filtered polymer or resin via a suitable conduit 46 or by other suitable conveyance means. The cutting device or pelletizer 44 functions to cut polymer strands extruded from the die 42 to convert the extruded polymer strands into generally cylindrical pellets of uniform length. The primary filtered polymer or resin is preferably conveyed to the container 45 in normally solid pellet form to facilitate subsequent handling of the polymer.

The subsystem 34 comprises an extruder 48 which receives normally solid primary filtered polymer, for example in the preferred pellet form, from a suitable primary filtered polymer storage container 45 via conduit 50 or other suitable conveyance means. The extruder 48, which may also be a single screw or a twin screw extruder of suitable capacity, melts the primary filtered polymer or resin and forces the thus produced primary filtered polymer melt through a suitable conduit 54 and the secondary filter 24, and further forces the thus produced secondary filtered polymer melt through one or more apertures in the spinneret 28 to produce one or more molten polymer filaments or fibers 30 which are subsequently cooled by suitable means (not shown), for example, fluid cooling such as air or water cooling, to provide polymer filaments or fibers.

Figure 4:
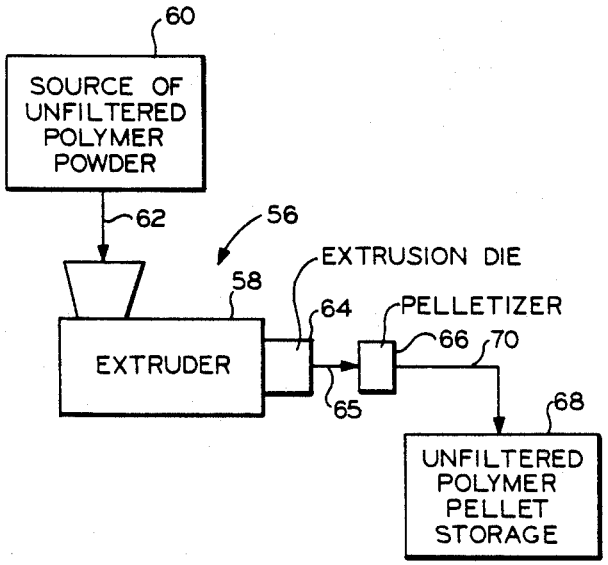
FIG. 4 is a schematic diagram of apparatus suitable for preparation of polymer pellets for use in the apparatus of FIGS. 1 and 2.

FIG. 4 illustrates a system 56 which provides means for converting unfiltered normally solid thermoplastic polymer in powdered form to unfiltered polymer pellets to facilitate subsequent handling and processing of the polymer. The system 56 comprises a suitable extruder 58 which receives normally solid unfiltered polymer resin, e.g., in powdered form, from a suitable source 60 via a conduit 62 or other suitable conveyance means. The extruder 58, which may also be a single screw or a twin screw extruder of suitable capacity, melts the unfiltered polymer and forces the resulting polymer melt through a suitable extrusion die 64, e.g., a strand die, a cooling zone 65 and a suitable strand cutting device or pelletizer 66 to a suitable storage container 68 via a suitable conduit 70 or by other suitable conveyance means. The strand cutting device or pelletizer 66 functions to cut the polymer strands extruded from the die 64 to convert the cooled polymer strands into generally cylindrical pellets of uniform length prior to introduction of the pellets into the container 68. It will be understood that it may be desirable in some cases to employ a relatively coarse filter element upstream of the extrusion die 64.

The apparatus illustrated in FIGS. 1–4 can be advantageously employed in the processing of any suitable normally solid thermoplastic polymer materials which require filtration prior to extrusion in the form of filaments or fibers. The illustrated apparatus is particularly effective in the filtration of poly(arylene sulfide) polymers, for example poly(phenylene sulfide) polymers, which are suitable for spinning filaments or fibers.

Poly(arylene sulfide) polymers, such as, for example, the p-phenylene sulfide polymer prepared by the process disclosed in U.S. Pat. No. 3,919,177 and other poly(phenylene sulfide) polymers comprising other co-monomers which do not adversely affect fiber formability, which are presently deemed suitable for filament spinning, are those polymers having a melt flow rate (ASTM D 1238-79, modified to a temperature of 600° F. using a 5 kg weight, value expressed as g/10 min) generaly within the range from about 50 to about 600 g/10 min, and more preferably in the range from about 150 to about 400 g/10 min.

Poly(arylene sulfide) polymers, such as, for example, the p-phenylene sulfide polymer prepared by the process disclosed in U.S. Pat. No. 3,919,177, which are presently deemed suitable for filament spinning, when processed in accordance with the present invention, are those poly(phenylene sulfide) polymers containing 1-chloronaphthalene insolubles generally in a concentration of about 40 or more, and preferably in a concentration in the range from about 50 to about 300 ppm. The following paragraph describes the procedure used in determining the concentration of 1-chloronapthalene insolubles in a sample of poly(phenylene sulfide).

For determining 1-chloronapthalene insolubles, the contents of two desicators, each about 20 cm in diameter, and each containing 950–1000 ml of 1-chloronapthalene, are heated and magnetically stirred to a solvent temperature at 235°–240° C. The desicator covers are each modified so as to receive a thermometer therethrough and to vent the interior of the associated desicator to the atmosphere. One of the heated containers, designated the dissolving container, is used for dissolving the poly(phenylene sulfide). The other container, designated the hot rinse container, is used for a rinse. Four wire cages, 5 cm×5 cm×4 cm deep, made of U.S. Sieve No. 325 stainless steel mesh, and having a wire handle, are used for holding a portion of the total 40.0 gram poly(phenylene sulfide) sample to be dissolved. The cages are preweighed to the nearest 0.01 mg, and then, with a portion of the poly(phenylene sulfide) sample, lowered into the hot 1-chloronaphthalene to within about 0.5 cm of the top of the cage. After the first portion of the poly(phenylene sulfide) is dissolved, subsequent portions of poly(phenylene sulfide) are added to the cages until all of the 40.0 gram sample is dissolved. Solution time usually ranges from about 1½ to about 5 hours. After complete solution of the sample, the cages are transferred to the hot rinse container for 20 minutes, then removed, rinsed with acetone, and dried in a circulating air oven at 150°-160° C. for 10 minutes. The cages are then reweighed after 5 minutes of cooling in air. Rinsing and drying are repeated until weights within 0.25 mg or values within 6 ppm are obtained.

In the particular case of poly(phenylene sulfide) polymers, such as those produced in accordance with U.S. Pat. No. 3,919,177, proper filtration is necessary for the preparation of polymer resin of sufficient purity to achieve acceptable commercial filament or fiber production. To achieve such purity in the melt filtration of poly(phenylene sulfide) polymer, it is presently found to be advantageous to employ a primary filter 18 having an absolute micron rating of no more than about 125, preferably in the range from about 45 to about 125, and more preferably having an absolute micron rating in the range from about 50 to about 100. A presently referred filter media for use in the filter 18 in the melt filtration of poly(phenylene sulfide) polymer is a depth type filter media comprising nonwoven metallurgically bonded microronic size stainless steel fibers. Such a filter media is available from Brunswick Technetics, Fluid Dynamics, 2000 Brunswick Lane, Deland, Fla. 32720, and is sold under the registered trademark DYNALLOY and is designated by the filter grade X13L. The X13L DYNALLOY filter media has a published mean micron rating of 46 and an absolute micron rating of 88.

With regard to the secondary filter 24 it is presently preferred to use a filter media having a maximum absolute micron rating of no more than about 80, or substantially equivalent filtration capacity, and more preferably having a maximum absolute micron rating in the range from about 59 to about 73, or substantially equivalent filtration capacity, in the melt filtration of poly(phenylene sulfide) polymer. A number of suitable filter media can be employed in the secondary filter 24 including spin packs employing various quantities of various sizes of sand particles as well as one or more superposed, wire mesh screens. In general, such quantities of sand should be of a depth at least adequate to provide effective filtration of polymer passing therethrough without exceeding an initial secondary filter spin pack pressure of about 3000 psig. Generally, suitable quantities of sand have a depth of at least about ¼ inch. Suitable sands generally include those sands which consist of particles small enough to pass through a 16 mesh screen and large enough to not pass through a 100 mesh screen.

Typically sands suitable for such filtration use are designated by the mesh size through which all of the particles of a quantity of the sand will pass, followed by the mesh size through which one of the particles of the quantity of sand will pass, such as, for example, 20/40. It will be understood that secondary filters constructed in accordance with this invention can employ superposed layers of sand such as, for example, successive superposed layers of 16/25, 20/40, 60/80 and 80/100 sands, or various combinations thereof. In the melt filtration of poly(phenylene sulfide) polymer, suitable results have been obtained by employing a secondary filter 24 comprising filter media of 60/80 mesh sand; 20/40 mesh sand; one edge sealed screen pack comprising one 325 mesh wire screen; 3 superposed edge sealed screen packs each comprising one 325 mesh wire screen; and 6 superposed edge sealed screen packs each comprising one 325 mesh wire screen. A secondary filter 24 in the form of a spin pack employing 3 superposed edge sealed screen packs each comprising a 325 mesh wire screen, in combination with a primary filter 18 employing a depth type filter media of metallurgically bonded micronic size stainless steel fibers having an absolute micron rating of about 88, provides melt filtration of commercially prepared poly(phenylene sulfide) polymer suitable for economical spinning of filaments or fibers of about 3 denier per filament of acceptable commercial quality.

The following example provides the basis for the foregoing statements.

EXAMPLE

Poly(phenylene sulfide) will be alternately referred to as PPS hereinafter. Melt filtrations of unfiltered poly(phenylene sulfide) polymer were performed on a ZSK-53 twin-screw extruder with two barrel sections. All PPS samples were prepared in accordance with the process disclosed in U.S. Pat. No. 3,919,177, issued to Campbell, and processed at a rate of about 15 kg/hr using a nitrogen blanket at the feed port and full vacuum (about 21 to about 24 inches of Mercury) on the second barrel vent. The extruder was purged with polypropylene and then with poly(phenylene sulfide) at the beginning of each run. The primary filter for runs 1 and 9-11 was a sealed 20/80/20 mesh combination screen pack. The primary filters for runs 2-8 and 12-20 were various filters supplied by Fluid Dynamics, each having a nominal filter area of 1 $ft^2$ on stream. The primary filtered polymer melt was extruded via a strand die in three extruded strands which were cooled in a water bath and then pelletized by means of a Cumberland pelletizer with the resulting pellets being dried with about 200° F. air to remove moisture.

The thus dried pellets were subsequently introduced into a 2-in. Hartig extruder located on the third floor of a plant and having three heating zones Z1, Z2 and Z3. The polymer melt from the Hartig extruder was passed through a suitable conduit in the form of a transfer manifold to a 4-pack, top-loaded spin block. Heating zone Z4 was located at the upstream end portion of the transfer manifold and heating zone Z5 includes the remaining portion of the transfer manifold and the spin block.

The extruder temperature conditions at each zone with one spin pack in the spin block were as follows: Z1, 570° F. (299° C.); Z2, 575° F. (302° C.); Z3, 575° F. (302° C.); Z4, 575° F. (302° C.); and Z5, 590° F. (310° C.). One of four spin packs can be employed with the spin block, but only the first spin pack position, or position A, was provided with a pressure read out. When four spin packs were used, the extruder temperatures were as follows: Z1, 593° F. (310° C.); Z2, 590° F. (310° C.); Z3, 585° F. (307° C.); Z4, 585° F. (307° C.); and Z5, 590° F. (310° C.).

The spin packs contained from one to six screen combinations. Each screen combination was an edge sealed group of 20/60/180/325/20 mesh screens. In runs 11 and 13 the spin packs contained 100 cc and 25 cc of 60/80 mesh sand, respectively, in addition to one of the aforementioned screen combinations. In run 20 the spin pack contained 25 cc of 20/40 mesh sand in addition to one of the aforementioned screen combinations. The secondary filtered polymer melt was extruded through a spinneret containing 68 holes, each hole having a diameter of 0.48 mm.

Directly below the spin block and spinneret, the extruded filaments or fibers were passed through an air quenched chamber on the second floor of the plant for quenching the hot thread line. For optimum spinnability, no quench air was used with those runs employing only one spin pack, and a low level of quench air (about 0.15 in. of water) was used with the runs employing four spin packs. The air quenched threadline was passed downwardly through a transfer chamber to the first floor of the plant where the filaments were taken up on an IWKA winder at speeds from about 900 to about 1100 meters per minute after application of a suitable spin finish by means of a kiss roll. An interfloor pressure differential of about +0.015 in. of water in runs 9–19 and an interfloor pressure of about +0.0125 in. of water in run 20 were used to obtain optimum thread line stability.

Extruder throughput and fiber and yarn deniers are summarized in Table I.

TABLE I

| Spin Pack Arrangement | Extruder Throughput, lb/hr | Take-up Speed, meters/min | Approximate Undrawn Yarn Denier | Approx. Drawn Yarn Denier | Drawn Filaments, Denier/Filament |
|---|---|---|---|---|---|
| One Spin Pack | 8.6 | 900 | 650 | 200 | 3 |
| | 10 | 900 | 800 | 250 | 3.7 |
| | 10 | 1100 | 650 | 200 | 3 |
| Four Spin Packs | 34.4 | 900 | 2600 | 800 | 3 |

Resin pellet preparation results are summarized in Table II. Runs 1–7 use polymer with a flow rate of 305 g/10 min and a 1-chloronapthalene insolubles level of about 68 ppm. Run 8 uses polymer with a flow rate of 310 g/10 min and a 1-chloronapthalene insolubles level of about 150 ppm.

Fiber spinning results are summarized in Table III. Runs 9–19 use various resins produced in Runs 1–7, while Run 20 uses the resin produced in Run 8.

TABLE II

Primary Melt Filtration of Poly(Phenylene Sulfide) Polymer

| Run | Primary Filter Element | Primary Filter Micron Mean | Primary Filter Rating Absolute | Time on Stream, hrs. | Final Filter Δ Pres., psi | Weight Processed, kg | Resulting Resin Designator | Resin Flow Rates, g/10 min. |
|---|---|---|---|---|---|---|---|---|
| 1 | 20/80/20[a] | 178 | 227 | 9⅔ | 445 | 155 | A | 282 |
| 2 | DM-40[b] | 40 | 70 | 10½ | 1080 | 162 | B | 292 |
| 3 | X13L[c] | 46 | 88 | 10⅔ | d | 172 | C[e] | 306 |
| 4 | X13L[c] | 46 | 88 | 10 | d | 158 | C[e] | 306 |
| 5 | X13L[c] | 46 | 88 | 10 | 40 | 166 | D[f] | 298 |
| 6 | X8L[g] | 16 | 25 | 5 | 1310 | 77 | E[h] | 302 |
| 7 | X8L[g] | 16 | 25 | 5½ | 1275 | 86 | E[h] | 302 |
| 8 | X13L[c] | 46 | 88 | 7¾ | 1210 | 125 | F | 319 |

[a]20/80/20 mesh screen pack of 2.75 in. diameter and 0.0412 ft² filter area in a sealed fixed breaker plate
[b]80 × 700 dutch twill woven stainless steel wire mesh screen (Fluid Dynamics, DYNAMESH 40)
[c]Depth type filter of metallurgically bonded micronic size stainless steel fibers (Fluid Dynamics, DYNALLOY ® X13L)
[d]No pressure build-up observed
[e]Resin C is a combination of the resins produced in runs 3 and 4
[f]Resin D is produced by subjecting 166 kg of Resin C to the melt filtration of run 5
[g]Depth type filter of metallurgically bonded micronic size stainless steel fibers (Fluid Dynamics, DYNALLOY ® X8L)
[h]Resin produced in runs 6 and 7 combined

TABLE III

Secondary Melt Filtration and Spinning of Poly(Phenylene Sulfide) Resin

| Run | PPS Resin from Table II | Primary Filter Element | Secondary Filter Element(s) | Spinnability[k] | Secondary Filter Spin Pack Pressure: Initial psig | Δ psi | Hours | Acceptability[o] |
|---|---|---|---|---|---|---|---|---|
| 9 | A | 20/80/20[a] | 1 Screen[f] | poor | 250 | 1550 | 8 | Mar |
| 10 | A | 20/80/20[a] | 6 Screens[g] | fair | 375 | 50 | 2 | Mar |
| 11 | A | 20/80/20[a] | 100 cc 60/80[h] mesh sand | excellent | 2500 | 2250 | 3 | Una |
| 12 | B | DM-40[b] | 1 Screen[f] | poor-fair | 250 | 750 | 16 | Acc |
| 13 | B | DM-40[b] | 25 cc 60/80[h] mesh sand | excellent | 950 | 475 | 5 | Mar |
| 14 | C | X13L[c] | 1 Screen[f] | fair-good | 250 | 25 | 6 | Acc |
| 15 | C | X13L[c] | 3 Screens[i] | good | 300 | 75 | 21½ | Acc |
| 16 | D | X13L[c,d] | 3 Screens[i] | excellent | 450 | 25 | 3½ | Acc |
| 17 | D | X13L[c,d] | 6 Screens[g] | good | 350 | 25 | 5½ | Acc |
| 18 | E | X8L[e] | 3 Screens[i] | good | 350 | 0 | 3 | Acc |
| 19 | E | X8L[e] | 6 Screens[i] | good | 350 | 0 | 5½ | Acc |
| 20 | F | X13L[e] | 25 cc 20/40[j] | [m] | 275 | [n] | 1 | [n] |

TABLE III-continued

| Secondary Melt Filtration and Spinning of Poly(Phenylene Sulfide) Resin | | | | | | | | |
|---|---|---|---|---|---|---|---|---|
| | PPS Resin from | Primary Filter | Secondary Filter | | Secondary Filter Spin Pack Pressure | | | |
| Run | Table II | Element | Element(s) | Spin-nability[k] | Initial psig | Δ psi | Hours | Accept-ability[o] |
| | | | mesh sand | | | | | |

[a]20/80/20 mesh screen pack of 2.75 in. diameter and 0.0412 ft² filter area in a sealed fixed breaker plate
[b]80 × 700 dutch twill woven stainless steel wire mesh screen (Fluid Dynamics, DYNAMESH 40)
[c]Depth type filter of metallurgically bonded micronic size stainless steel fibers (Fluid Dynamics, DYNALLOY ® X13L)
[d]Two passes through primary filter
[e]Depth type filter of metallurgically bonded micronic size stainless steel fibers (Fluid Dynamics, DYNALLOY ® X8L)
[f]A spin pack comprising one screen combination in the form of an edge sealed 20/60/180/325/20 mesh group of screens
[g]A spin pack comprising six superposed screen combinations each in the form of an edge sealed 20/60/180/325/20 mesh group of screens
[h]A spin pack comprising one screen combination in the form of an edge sealed 20/60/180/325/20 mesh group of screens and a quantity of 60/80 mesh sand upstream therefrom
[i]A spin pack comprising three superposed screen combinations each in the form of an edge sealed 20/60/180/325/20 mesh group of screens
[j]A spin pack comprising one screen combination in the form of an edge sealed 20/60/180/325/20 mesh group of screens and a quantity of 20/40 mesh sand upstream therefrom
[k]Poor = almost continual filament breaks and wraps
Fair = several broken filaments and wraps during each doff
Good = just occasional wraps during run
Excellent = no breaks or wraps during run
[m]Run time too brief to determine spinnability
[n]Run time too brief to determine pressure change
[o]Mar = marginal = 12–20 hours to 5000 psig secondary filter pack pressure
Una = unacceptable = Less than 4 hours to 5000 psig secondary filter pack pressure
Acc = acceptable = more than 24 hours to 5000 psig secondary filter pack pressure
Acceptability is based on extrapolation of pressure-time curve.

Runs 9–11 show that spinning performance of poly(phenylene sulfide) resin, primary filtered 80 mesh screen, improved as the amount of secondary filtration in the spin pack increased. With 100 cc of 60/80 mesh sand in Run 11, no breaks or wraps were observed in the filaments; however, initial pack pressure was relatively high, 2500 psig, and the pack pressure increased rapidly.

Runs 12 and 13 show that spinning performance of poly(phenylene sulfide) resin, primary filtered with a DYNAMESH 40 screen, was improved over that of the resin of Runs 9–11. Run 13 shows that a spin pack containing 25 cc of 60/80 mesh sand gives much better spinning performance with an initial pressure of 950 psig and a fairly modest rise in pressure (475 psi increase in 5 hours). A very crude extrapolation of the pressure-time curve of Run 13 suggests that the maximum pressure of 5000 psig at the secondary filter would be reached in an only marginally suitable period of time. Run 13 further suggests the possibility of using a coarser sand to achieve good spinning performance, lower initial pack pressure and acceptable secondary filter spin pack life (e.g. 24 hours) with a DYNAMESH 40 screen-primary filtered resin.

Runs 14 and 15 show improved spinning performance of poly(phenylene sulfide) resin primary filtered with a DYNALLOY X13L depth type filter. Only a negligible amount of pressure increase was shown to occur in Run 14 with the secondary filter spin pack comprising one 325 mesh edge sealed screen combination. Run 15 employed a secondary filter spin pack comprising three superposed 325 mesh edge sealed screen combinations, and shows spinning performance improvement over Run 14 without any significant secondary filter pack pressure increase. The secondary filter spin pack was run for 21½ hours in Run 15, and the same secondary filter spin pack was run for 6½ additional hours in Runs 16 and 18 for a total of 28 hours with a pressure increase of only about 100 psi, which value is approximate due to baseline shifts and difficulty in reading the pressure chart.

Runs 17 and 19 show the results of utilization of four parallel secondary filter spin packs, each comprising six superposed 325 mesh edge sealed screen combinations at an extruder throughput of about 34.4 lb/hr with yarn takeup at about 900 meters per minute. Spinning in Runs 17 and 19 shows very little secondary filter spin pack pressure increase over 11 hours (the same secondary filter spin packs were used for runs 17 and 19) with good spinning performance. Run 20 shows that the use of 25 cc of a coarser 20/40 mesh sand with a 325 mesh screen combination as a secondary filter spin pack provides an initial pack pressure of 275 psig. Thus, Run 20 shows a substantial reduction in initial secondary filter spin pack pressure from the 950 psig experienced in Run 13 and suggests that the expected corresponding increase in secondary filter pack pressure would be acceptable, although Run 20 was not of sufficient duration to absolutely verify such a conclusion. Run 20 was performed for the limited purpose of determining the amount of reduction in initial secondary filter spin pack pressure resulting from use of a coarser sand in the secondary filter spin pack.

From the results shown in Tables I, II and III, and the discussion above, it is shown that poly(phenylene sulfide) resin, primary filtered through a depth type filter comprising metallurgically bonded micronic size nonwoven stainless steel fibers having a mean micron rating of 46 and an absolute micron rating of 88, can be spun with a secondary filter comprising three superposed screen combinations in a commercially acceptable process to produce synthetic filaments or fibers suitable for use as staple fibers.

It will be evident that modifications can be made to the method and apparatus described above without departing from the spirit and scope of the present invention as defined and limited only by the following claims.

That which is claimed:

1. A method of processing a polymer comprising poly(arylene sulfide), comprising the steps of:

forcing molten polymer comprising poly(arylene sulfide) through primary filter means comprising a depth type filter comprising metallurgically bonded metal fibers and having an absolute micron rating in the range from about 45 to about 125 to provide molten primary filtered polymer; and forcing said molten primary filtered polymer through secondary filter means having a maximum absolute micron rating of no more than about 80 or a substantially equivalent filtration capability to provide molten secondary filtered polymer.

2. A method in accordance with claim 1 wherein the maximum absolute micron rating of said primary filter means is no more than about 100.

3. A method in accordance with claim 2 wherein said secondary filter means comprises a plurality of superposed mesh screens.

4. A method in accordance with claim 2 wherein said secondary filter means comprises three superposed mesh screens.

5. A method in accordance with claim 4 wherein said mesh screens are U.S. Standard Sieve 325 mesh screens.

6. A method in accordance with claim 1 wherein said secondary filter means comprises three superposed screens each having an absolute micron rating in the range from about 59 to about 73.

7. A method in accordance with claim 1 wherein said secondary filter means comprises at least one mesh screen and a quantity of sand.

8. A method in accordance with claim 1 wherein said secondary filter means comprises a plurality of superposed metal mesh screens each having an absolute micron rating from about 59 to about 73.

9. A method in accordance with claim 8 wherein said polymer comprises poly(phenylene sulfide).

10. A method in accordance with claim 8 wherein said poly(arylene sulfide) is characterized further as having a concentration of 1-chloronapthalene insolubles of at least 40 ppm.

11. A method in accordance with claim 9 wherein said poly(phenylene sulfide) is characterized further as having a concentration of 1-chloronapthalene insolubles in the range from about 50 to about 300 ppm.

12. A method in accordance with claim 8 wherein said poly(arylene sulfide) is characterized further as having a melt flow rate in the range from about 50 to about 600 g/10 min.

13. A method in accordance with claim 9 wherein said poly(phenylene sulfide) is characterized further as having a melt flow rate in the range from about 150 to about 400 g/10 min.

14. A method in accordance with claim 10 characterized further to include the step of extruding the secondary filtered polymer into an extruded product.

15. A method in accordance with claim 14 wherein said polymer comprises poly(phenylene sulfide).

16. A method in accordance with claim 14 wherein said poly(arylene sulfide) is characterized further as having a concentration of 1-chloronapthalene insolubles of at least 40 ppm.

17. A method in accordance with claim 15 wherein said poly(phenylene sulfide) is characterized further as having a concentration of 1-chloronapthalene insolubles in the range from about 50 to about 300 ppm.

18. A method in accordance with claim 16 wherein said poly(arylene sulfide) is characterized further as having a melt flow rate in the range from about 50 to about 600 g/10 min.

19. A method in accordance with claim 17 wherein said poly(phenylene sulfide) is characterized further as having a melt flow rate in the range from about 150 to about 400 g/10 min.

20. A method in accordance with claim 1 wherein said polymer comprises poly(phenylene sulfide).

21. A method in accordance with claim 20 wherein said poly(phenylene sulfide) is characterized further as having a concentration of 1-chloronapthalene insolubles in the range from about 50 to about 300 ppm.

22. A method in accordance with claim 20 wherein said poly(phenylene sulfide) is characterized further as having a melt flow rate in the range from about 150 to about 400 g/10 min.

23. A method in accordance with claim 1 wherein said poly(arylene sulfide) is characterized further as having a concentration of 1-chloronapthalene insolubles of at 40 ppm.

24. A method in accordance with claim 1 wherein said poly(arylene sulfide) is characterized further as having a melt flow rate in the range from about 50 to about 600 g/10 min.

25. A method of processing a normally solid thermoplastic material for melt spinning into fibers comprising the steps of:

passing molten poly(arylene sulfide) through primary filter means comprising depth type filter media comprising metallurgically bonded metal fibers and having an absolute micron rating in the range from about 45 to about 125 to provide molten primary filtered polymer; and passing said molten primary filtered polymer through secondary filter means having an absolute micron rating less than or a substantially equivalent filtration capacity greater than the absolute micron rating or the substantially equivalent filtration capacity of said primary filter means.

26. A method in accordance with claim 25 wherein said secondary filter means comprises at least one U.S. Standard Sieve 325 mesh screen.

27. A method in accordance with claim 25 wherein said secondary filter means comprises three superposed U.S. Standard Sieve 325 mesh screens.

28. A method in accordance with claim 25 wherein said secondary filter means comprises one U.S. Standard Sieve 325 mesh screen and a quantity of sand.

29. A method in accordance with claim 28 wherein said sand is 20/40 U.S. Standard Sieve mesh sand.

30. A method in accordance with claim 28 wherein said sand is 60/80 U.S. Standard Sieve mesh sand.

31. A method in accordance with claim 25 wherein said molten poly(arylene sulfide) comprises poly(phenylene sulfide).

32. A method in accordance with claim 31 wherein said poly(phenylene sulfide) is characterized further as having a concentration of 1-chloronapthalene insolubles of at least 40 ppm.

33. A method in accordance with claim 31 wherein said poly(phenylene sulfide) is characterized further as having a melt flow rate in the range from about 50 to about 600 g/10 min.

34. A method in accordance with claim 25 wherein said poly(arylene sulfide) has a concentration of 1-chloronapthalene insolubles of at least 40 ppm.

35. A method in accordance with claim 25 wherein said poly(arylene sulfide) has melt flow rate in the range from about 50 to about 600 g/10 min.

36. A method of processing a polymer comprising poly(arylene sulfide), comprising the steps of:

forcing molten polymer comprising poly(arylene sulfide) through primary filter means comprising depth type filter media of metallurgically bonded metal fibers having an absolute micron rating in the range from about 45 to about 125 to provide a first quantity of molten primary filtered polymer;

forming said molten primary filtered polymer into a plurality of primary filtered polymer pellets;

melting said primary filtered polymer pellets to provide a second quantity of molten primary filtered polymer; and forcing said second quantity of molten primary filtered polymer through second filter means having a maximum absolute micron rating of no more than about 80 or a substantially equivalent filtration capacity to provide molten secondary filtered polymer.

37. A method in accordance with claim 36 characterized further to include the step of extruding the secondary filtered polymer into an extruded polymer product.

38. A method in accordance with claim 36 or claim 37 wherein said molten polymer comprises poly(phenylene sulfide) having a concentration of 1-chloronapthalene insolubles of at least 40 ppm.

39. A method in accordance with claim 36 or claim 37 wherein said molten polymer comprises poly(arylene sulfide) having a concentration of 1-chloronapthalene insolubles of at least 40 ppm.

40. A method in accordance with claim 36 or claim 37 wherein said molten polymer comprises poly(arylene sulfide) having a melt flow rate in the range from about 50 to about 600 g/10 min.

41. A method of forming fibers from a polymer comprising poly(arylene sulfide) which has previously been subjected to primary filtration through primary filter means comprising a depth type filter of metallurgically bonded metal fibers having an absolute micron rating in the range from about 45 to about 125 to form a primary filtered polymer, comprising:

melting the primary filtered pellets to provide molten primary filtered polymer and passing said molten primary filtered polymer through secondary filter means having a maximum absolute micron rating of no more than about 80 or a substantially equivalent filtration capacity to provide molten secondary filtered polymer; and thereafter forming fibers from said secondary filtered polymer.

42. A method in accordance with claim 41 wherein the polymer has a concentration of 1-chloronapthalene insolubles of at least 40 ppm prior to passage through said primary filter means.

43. A method in accordance with claim 41 wherein the polymer comprises poly(phenylene sulfide) having a concentration of 1-chloronapthalene insolubles in the range from about 50 to about 300 ppm prior to passage through said primary filter means.

44. A method in accordance with claim 41 wherein the polymer has a melt flow rate in the range from about 50 to about 600 g/10 min prior to passage through said primary filter means.

45. A method in accordance with claim 41 wherein said secondary filter means comprises a plurality of superposed mesh screens.

46. A method in accordance with claim 41 wherein said secondary filter means comprises three superposed mesh screens each having an absolute micron rating in the range from about 59 to about 73.

47. A method in accordance with claim 41 or claim 25 wherein said secondary filter means comprises at least one mesh screen and a quantity of sand.

48. A method in accordance with claim 47 wherein said quantity of said is 20/40 U.S. Standard Sieve mesh sand.

49. A method in accordance with claim 47 wherein said quantity of sand is 60/80 U.S. Standard Sieve mesh sand.

50. A method in accordance with claim 41 wherein said secondary filter means comprises three superposed U.S. Standard Sieve 325 mesh screens.

51. A method of processing a polymer comprising poly(arylene sulfide), comprising the steps of:

passing molten polymer comprising poly(arylene sulfide) through primary filter means comprising a depth type filter comprising metallurgically bonded metal fibers and having an absolute micron rating in the range from about 45 to about 125 to provide molten primary filtered polymer; and passing said molten primary filtered polymer through secondary filter means to remove impurities which pass through said primary filter means and provide molten secondary filtered polymer.

52. A method in accordance with claim 51 wherein said polymer is characterized further as having a concentration of 1-chloronapthalene insolubles of at least 40 ppm.

53. A method in accordance with claim 51 wherein said polymer is characterized further as having a melt flow rate in the range from about 50 to about 600 g/10 min.

54. A method in accordance with claim 47 wherein said quantity of sand has a depth sufficient to provide effective filtration of polymer passing therethrough without exceeding an initial pressure of 3000 psig at said second filter means.

55. A method in accordance with claim 47 wherein said quantity of sand has a depth of at least about ¼ inch.

56. A method in accordance with claim 47 wherein said quantity of sand consists of particles which will pass through a 16 U.S. Standard Sieve mesh screen and will not pass through a 100 U.S. Standard Sieve mesh screen.

57. A method in accordance with claim 7 or claim 28 wherein said quantity of sand has a depth sufficient to provide effective filtration of polymer passing therethrough without exceeding an initial pressure of 3000 psig at said second filter means.

58. A method in accordance with claim 7 or claim 28 wherein said quantity of sand has a depth of at least about ¼ inch.

59. A method in accordance with claim 7 or claim 28 wherein said quantity of sand consists of particles which will pass through a 16 U.S. Standard Sieve mesh screen and will not pass through a 100 U.S. Standard Sieve mesh screen.

60. A method in accordance with claim 1 comprising the additional step of:

forcing molten polymer comprising poly(arylene sulfide) through filter means having a maximum absolute micron rating greater than the absolute micron rating of said primary filter means prior to said step of forcing molten polymer comprising poly(arylene sulfide) through said primary filter means to provide said polymer comprising poly- (arylene sulfide) to said step of forcing molten polymer comprising poly(arylene sulfide) through primary filter means.

61. A method in accordance with claim 25 characterized further to include:

passing molten poly(arylene sulfide) through a relatively coarse filter means having an absolute micron rating greater than the absolute micron rating of said primary filter means to provide relatively coarse filtered poly(arylene sulfide) to the step of passing molten poly(arylene sulfide) through primary filter means.

62. A method in accordance with claim 51 characterized further to include:

passing molten polymer comprising poly(arylene sulfide) through relatively coarse filter means having an absolute micron rating greater than the absolute micron rating of said primary filter means to provide relatively coarse filtered polymer comprising poly(arylene sulfide) through primary filter means.

* * * * *